United States Patent [19]

Schmid

[11] 3,961,400

[45] June 8, 1976

[54] PERFORATED DRUM DRIER

[75] Inventor: Walter Schmid, Gaertringen, Germany

[73] Assignee: Erich Kiefer, Lufttechnische Anlagen G.m.b.H., Gaertringen, Germany

[22] Filed: Aug. 10, 1971

[21] Appl. No.: 170,592

[30] Foreign Application Priority Data

Sept. 7, 1970 Germany ..... 2044217

[52] U.S. Cl. ..... 26/80; 34/115; 26/92

[51] Int. Cl.[2] ..... D06C 3/02

[58] Field of Search ..... 26/59, 60, 18.5, 55 R, 26/56; 34/115, 242

[56] References Cited

UNITED STATES PATENTS

| | | | |
|---|---|---|---|
| 1,401,589 | 12/1921 | Cunningham | 26/56 X |
| 2,144,151 | 1/1939 | Heinen | 26/18.5 |
| 2,588,624 | 3/1952 | Evans, 2nd | 26/56 X |
| 2,680,279 | 6/1954 | Hamilton | 26/55 R |
| 2,818,661 | 1/1958 | Warner | 34/242 |
| 3,371,428 | 3/1968 | Thygeson, Sr. et al. | 26/60 UX |
| 3,503,134 | 3/1970 | Fleissner | 26/60 X |
| 3,521,378 | 7/1970 | Fleissner | 26/60 X |
| 3,533,245 | 10/1970 | Komberec et al. | 34/242 X |
| 3,570,137 | 3/1971 | Fleissner | 26/60 UX |
| 3,605,280 | 9/1971 | Fleissner | 26/60 X |
| 3,672,010 | 6/1972 | Fleissner | 26/60 |

FOREIGN PATENTS OR APPLICATIONS

| | | | |
|---|---|---|---|
| 1,018,531 | 1/1966 | United Kingdom | 34/115 |

*Primary Examiner*—Robert R. Mackey
*Attorney, Agent, or Firm*—Cushman, Darby & Cushman

[57] ABSTRACT

A perforated drum drier with a first lower inlet opening in a rear wall of a drier housing for feeding a tubular knit fabric to a first drum in the housing, and with a substantially horizontal stentering chain mechanism extending through a second upper inlet opening into the housing to a front guide roller for the two pin-studded stentering chains, the axis of which is located slightly ahead of a vertical plane extending through the axis of the first drum, and so far above the first drum that the parts of the lower stringers of the chains adjacent to the front guide roller are substantially in horizontal alignment with the top of the first drum so that an open fabric will be removed from the pins of the chains by its own gravity and by the suction of the first drum and be transferred simultaneously to this drum. The stentering mechanism is located so highly from the floor that an operator can stand underneath it.

7 Claims, 2 Drawing Figures

INVENTOR

WALTER SCHMID

Figure 2:
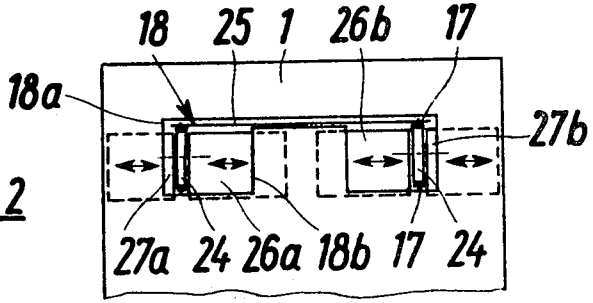

BY Craig, Antonelli & Hill
ATTORNEYS

PERFORATED DRUM DRIER

The present invention relates to a perforated drum drier for treating sheet material and more particularly for drying, setting or shrinking tubular as well as open knit fabrics.

The prior art discloses perforated drum driers for drying open knit fabrics, that is, either fabrics which have been cut open from their original tubular shape or open warp-knit fabrics. These driers are provided with needle-studded stentering chains which supply the fabric to the first drum of the drier approximately at the center of its height. These driers have the disadvantage that they can be employed only for treating open fabrics and not also for drying or setting uncut tubular fabrics. Furthermore, the transfer of the open fabric from the stentering mechanism to the perforated drum does not occur uniformly because it is carried out within the area of the reversal of the direction of travel of the stentering chains where the adjacent chain links which then together form a polygon are not spaced uniformly from the perforated drum.

Among the perforated drum driers as are presently known there is another type in which the fabric is transferred from the stentering chains to the drying drum within the lower area of the drum. The fabric is then removed from the upper stringers of the stentering chains by being sucked up by and upon the perforated drum which is located above the stentering chains. This type of drum drier has the disadvantage that the fabric must be removed from the needles of the stentering chains in an upward direction which cannot be properly carried out in all cases, especially if the fabric has a heavier weight. Such driers must therefore always be provided with special devices for removing the fabric from the needles. Furthermore, the drying area of such a drum drier is considerably reduced since only one quarter of the peripheral surface of the first drum can be utilized for drying the fabric. Last but not least, such a perforated drum drier also cannot be employed for drying tubular fabrics. Therefore, for this purpose it has so far always been necessary to provide an additional perforated drum drier of a different construction which comprises a shrinking roller or a feed belt for transferring the fabric to the first drying drum.

Although perforated drum driers have already been proposed which are equipped with stentering chains and also with a feed belt for supplying tubular fabrics to the drier, these driers always require the stentering chains to be located within the lower area of the first drier drum just like the drum driers as previously described, while the feed belt must be located above the stentering chains. These driers have especially the disadvantage that there is no space for the operator in front of the drier and that this deficiency can only be partly corrected by the provision of a bridge structure which covers the stentering mechanism and from which the feed belt for the tubular fabric is accessible. When the stentering mechanism of this drier is employed, the latter has also the disadvantage that the fabric can be removed from the needles of the stentering chains only in the upward direction and that the drying surface of the first perforated drum can only be partly utilized.

It is an object of the present invention to provide a perforated drum drier which eliminates all of the mentioned disadvantages of the driers as are presently known and may be alternately employed either for treating open knit fabrics, for example, originally tubular knit fabrics which have been cut open or open warp-knit fabrics, by being provided with a stenter chain mechanism, or for treating tubular knit fabrics. Another object of the invention is to design such a drier so as to have an adequate space for the operator available directly in front of the first drum of the drier underneath the stentering mechanism. Further objects of the invention are to design this drier so as to permit the fabric to be easily removed from the pins of the stentering chains for transferring it to the first drying drum and to carry out this transfer in a manner so as to utilize the peripheral surface of the first drum to the greatest possible extent.

For attaining these objects, the invention provides that the stentering mechanism extends in a substantially horizontal direction and so far above the other feeding mechanism for tubular fabrics that the axis of the front guide roller for the stentering chains which is mounted adjacent to the first drum of the drier is located slightly in front of the vertical plane extending through the center of the drum and so that the parts of the lower stringers of the stentering chains which are adjacent to the front guide roller extend substantially tangentially to the highest part of the peripheral surface of the first drum. By mounting the stentering mechanism at such a high elevation, sufficient room is attained at the front side of the first perforated drum to permit the operator of the machine to stand erect in this position and also to provide in this room a felt-covered shrinking roller or a feed belt. Another important feature of the drier according to the invention is the fact that the open fabric will be removed from the needles of the stentering chains in the downward direction, that is, from the lower stringers of the chains after passing over their front guide roller, and that therefore even heavier fabrics can also be easily removed and transferred to the first drying drum. Although the fabric is still stretched in width by the vertical or slightly outwardly inclined needles projecting downwardly from the lower chain stringers which travel horizontally and tangentially to and away from the first drum, a slightly parabolic sagging of the fabric is unavoidable which is caused by its own weight and varies in accordance with the structure, quality, and width of the fabric. This sag will, however, be taken up immediately and completely by the peak of the peripheral surface of the first drum where it will be sucked tightly upon this surface by the air suction.

Due to the particular manner of mounting the stentering mechanism according to the invention it is not only possible to attain the largest possible space underneath this mechanism at the front side of the first drying drum, but it is also possible to carry the open fabric while still stretched in width on this mechanism far into the insulated, heated and ventilated housing of the drier. The first setting operation may thus be carried out while the fabric is still stretched in width and therefore the disadvantage of a shrinkage of the fabric during this setting operation is completely avoided. For this purpose, it is also of particular advantage to provide a conventional steamer for preheating and moistening the fabric during the setting operation before it passes on the stentering chains into the drier housing.

In this connection it may be important to point out that prior to this invention it was generally believed that, in order to prevent the quality of the fabric from being reduced by being stretched by the reversal of the directions of travel of the stentering chains on the front guide rollers, it was necessary to remove the fabric from the needles of these chains before they reached this area of reversal. The present invention has, however, shown that this belief is erroneous and that, on the contrary, very important advantages are attained if the drum drier is designed in accordance with the invention and the fabric after being supplied on the upper chain stringers is removed from the needles of the stentering chains in the downward direction from the lower chain stringers.

In order to close the inlet opening for the stentering mechanism into the drier housing as tightly as possible without affecting the possibility of adjusting the width between the stentering chains, it has been found advisable to make this inlet opening of the drier housing of an inverted U-shape and to extend the lateral guide walls of the chains through the downwardly projecting arms of this U-shaped opening. The width of each of these arms should preferably correspond to one half of the greatest width to which the stentering chains and their vertical guide walls can be adjusted from each other and two pairs of wall elements should be provided which are slidable horizontally relative to each other and into close engagement with both sides of the two guide walls of the chains.

Another feature of the invention consists in mounting the shrinking roller or the feed belt underneath the stentering chains within a horizontal plane extending substantially through the center of the first drier drum. This has the advantage that when this drum is made of the usual dimensions, the housing inlet for the tubular fabric is located at such a height that the operator may very easily feed the fabric to this inlet since no space is taken up by the stentering mechanism in front of the drier housing. In front of the shrinking roller or the feed belt it is also possible to provide a stretcher for stretching the tubular fabric in width if it should be desired that it be set at a certain width.

In order to prevent the shrinking roller or the feed belt when standing still from being exposed to the high temperatures prevailing within the drier housing, that is, when an open fabric is inserted by means of the stentering mechanism into the housing, it is another feature of the invention to provide a shutterlike partition which is movable upwardly from a position underneath the shrinking roller or feed belt to a position between this roller or feed belt and the first drier drum so as to shut off the inlet opening of the housing. This partition may be raised or lowered either by hand or automatically before one or the other type of operation of the drier is to be carried out.

Another feature of the invention consists in providing a wind screen at the inside of the first drum, a section of which is adapted to be pivoted away from the drum wall toward the inside of the drum when an open fabric is to be fed into the drier housing by the stentering mechanism and is to be transferred downwardly from the latter upon the first drum. Depending upon which type of operation is to be carried out, that is, whether an open fabric or a tubular fabric is to be treated and the fabric is to be supplied either to the peak of the drum or substantially within a central horizontal plane of the drum, it is possible to ventilate one half or substantially three quarters of the periphery of the drum and to utilize this part for the treatment of the respective fabric. At the outlet side of the drier it is advisable to provide a cooling drum for cooling and stabilizing the loops especially of synthetic fabrics.

Figure 1:
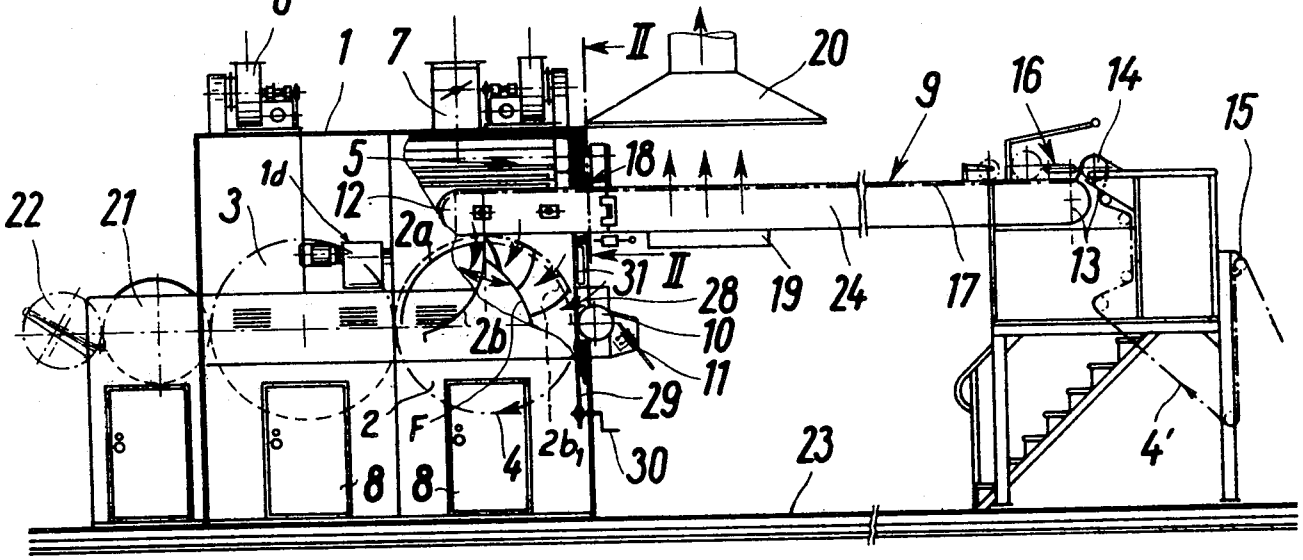

These and additional features and advantages of the present invention will become more clearly apparent from the following detailed description thereof which is to be read with reference to the accompanying drawings, in which:

FIG. 1 shows a diagrammatic side view of a perforated drum drier according to the invention, the housing of which is partly broken away to show the inside thereof, while FIG. 2 shows a view of a part of the drier which is taken in the direction of the arrows II — II and within a vertical plane connecting these arrows.

In these drawings, FIG. 1 shows a drier housing 1 in which two drums 2 and 3 are rotatably mounted, each of which has a perforated screenlike peripheral wall and is turned by suitable driving means 1d, in the direction as indicated by the arrows 4. One or both ends of the drums are connected to the suction side of one or more fans F so that a strong suction is produced at the inside of the drums which causes the air which is circulated at the inside of housing 1 to flow through the perforated walls of the drums to the inside thereof. For heating the circulated air, heating elements 5 are mounted in the upper part of housing 1 and in addition a flue-gas fan 6 and a vent 7 are mounted on the upper side of housing 1. The lower part of at least one side wall of the drier housing is further provided with doors 8 to permit a person to enter the housing, for example, for carrying out repairs or cleaning operations.

For feeding the textile fabric to be treated to the drum drier, the latter is provided with two feeding mechanisms, namely, a pin-studded stentering chain mechanism 9 for open knit fabrics, as shown in operation in FIG. 1, and with a shrinking roller 10 and in front of it with a spreader 11 for tubular knit fabrics. The stentering mechanism 9 comprises two guide rollers 12 and 13 at its opposite ends, a feed roller 14 in front of the guide roller 13, and additional guide rollers 15 for conducting an open knit fabric in the direction of the arrow 4' to the feed roller 14 and over it upon the pins of the two stentering chains 17 upon which the fabric is pressed by suitable means 16 above the two chains which then convey the fabric to the drier housing 1 and pass it through an inlet opening 18 to the inside of this housing. In front of the inlet opening 18 a steamer 19 including a hood 20 are mounted which are provided for preheating and moistening the fabric to be treated, for example, for setting the same. At the inside of the drier housing 1 the fabric passes over the guide roller 12 on which it is turned about an angle of 180° so that its direction of travel is reversed. Since shortly after passing over the guide roller 12 the fabric is sucked toward and against the perforated wall of the first drier drum 2 which is rotating in the direction of the arrow 4, the originally horizontal movement of the fabric caused by the stentering chains changes into a circular movement away from the lower stringers of the chains so that the downward traction upon the fabric caused by its own weight will be increased by a traction component caused by the suction of drum 2 which will draw the fabric automatically off the needles on the stentering chains 17. The fabric will then travel around approximately three quarters of the periphery of drum 2 and will then be transferred to the other perforated drum 3 from which it will pass over a cooling drum 21 and will then either be wound up by a reel 22 or pass to a folder, not shown.

As illustrated in FIG. 2, one end wall of the drier housing 1 is provided with an inlet opening 18 which has an inverted U-shape. Between the downwardly projecting side walls of this opening 18 the guide walls 24 extend, along the narrow upper and lower sides of which the pin-studded stentering chains 17 are guided. The upper stringers of these chains carry the fabric 25 in a laterally stretched condition. Since different fabrics 25 to be treated may also be of different widths, suitable adjusting means, not shown, are provided for adjusting the distance between the stentering chains 17 and also between the guide walls 24. Each of the two guide rollers 12 and 13 may consist, for example, of two cylindrical parts which are telescopically slidable along each other and may thus be adjusted to different total lengths. Furthermore, each of the vertical parts 18*a* and 18*b* of the U-shaped inlet opening 18 of the drier housing 1 should have a width depending upon the minimum and maximum width to which the chains 17 and guide walls 24 should be adjustable relative to each other. In order to close the vertical parts 18a and 18b of the inlet opening 18 as tightly as possible, two pairs of plates or the like 26*a*, 27*a* and 26*b* 27*b* are mounted on the end wall of housing 1 and the plates of each pair are slidably adjustable relative to each other in the directions as indicated by the arrows in FIG. 2 so as to engage with both lateral sides of the guide walls 24, preferably by means of springs which tend to draw the plates of each pair toward each other and thus tightly against the guide walls 24.

When the drier according to the invention is to be operated for treating an open knit fabric, this fabric is conveyed toward and into the drier housing 1 by means of the pin-studded stentering chains 17 and then around the front guide roller 12. Previously, the pivotable section 2*b* of the wind screen 2*a*, 2*b* at the inside of the perforated wall of drum 2 is pivoted to the position as shown by the solid line in FIG. 1 so that the fabric will be subjected to the suction in drum 2 and be drawn off the pins of chains 17 and sucked against the perforated wall of drum 2. In order to prevent any air from entering the housing 1 through the inlet opening 28 for tubular fabrics which is not to be used at this time, a movable partition or shutter 29 is provided which may then be shifted either by a crank 30 or automatically to the full-line position as shown in FIG. 2 so as to close this inlet opening 28 tightly. The end wall of housing 1 is further provided with a window 31 through which the transferring and drying operation on drum 2 may be observed.

The lower side of the stentering mechanism 9 is preferably spaced at a distance of 2 to 2.5 meters from the floor 23 so that an operator may stand in front of the drier housing 1 without stooping especially when the stentering mechanism 9 is stopped and when he draws a tubular knit fabric over the stretcher 11 and feeds it over the shrinking roller 10 and through the inlet opening 28 to the perforated drum 2 after the partition 29 has been cranked downwardly so as to open the inlet opening 28 and after the section 2b of the wind screen has been pivoted upwardly to the position 2b, as shown by a dotted line. The drive means of the stentering mechanism 9 are then stopped and those of the shrinking roller 10 are started. The drier is then ready for treating a tubular fabric which, as already stated, is passed over the stretcher 11 and the shrinking roller 10 and through the inlet opening 28 upon the drum 2 and then along the lower half of this drum to the other perforated drum 3 from which the fabric may pass over the cooling drum 21 to the winding reel 22 or to a folder, not shown.

The present invention thus provides a perforated drum drier which is universally applicable for treating open or tubular knit fabrics and thus eliminates the need for a second drier for one or the other kind of fabric and additionally has a series of advantages over all driers as were previously designed.

Although my invention has been illustrated and described with reference to the preferred embodiment thereof, I wish to have it understood that it is in no way limited to the details of such embodiment but is capable of numerous modifications within the scope of the appended claims.

Having thus fully disclosed my invention, what I claim is:

1. A perforated drum drier for alternately treating an open knit fabric or a tubular knit fabric, comprising a drier housing having front and rear end walls and an upper inlet opening and a lower inlet opening in said rear end wall, at least two drums rotatably mounted in a row behind and parallel to each other in said housing and having perforated peripheral walls, the first of said drums being located adjacent to said rear end wall, means connected to said drums for producing a suction at the inside of said drums, first lower feeding means connected to said rear end wall for feeding a tubular fabric through said lower opening to said first drum, said first feeding means including a shrinking roller mounted on said rear end wall closely adjacent to said lower inlet opening, said lower inlet opening being disposed substantially within a horizontal plane extending through the axis of said first drum, and second upper feeding means located considerably above said first feeding means and comprising a front guide roller mounted within said housing, a rear guide roller mounted outside of said housing and spaced from said rear end wall, a pair of endless pin-studded stentering chains parallel to and laterally spaced from each other and movable between and over said guide rollers and forming upper and lower chain stringers extending substantially horizontally between said guide rollers and through said upper opening into and from said housing, and means for rotating said drums and for driving said chains, said first guide roller having an axis located at a short distance beyond a vertical plane extending through the axis of said first drum and so far above said first drum that the part of said lower stringers adjacent to said front guide roller is substantially in horizontal alignment with the top of the perforated wall of said first drum so than an open fabric fed on said upper stringers toward said first guide roller, after passing around the latter and turning an angle of substantially 180° to reverse the direction of travel, will be removed from the pins of said chains by its own gravity and by the suction of said first drum and will be transferred substantially simultaneously to the peripheral perforated wall of said first drum while said drum is rotating in the same general direction in which said lower stringers are moved substantially horizontally.

2. A perforated drum drier as defined in claim 1, further comprising a steamer associated with said second feeding means and located outside of said housing in a position before the entry of said chains through said upper opening into said housing for preheating and moistening the open fabric on the upper stringers of said chains.

3. A perforated drum drier as defined in claim 1, in which said first feeding means further comprise a stretcher in front of said shrinking roller for stretching said tubular fabric to a certain width.

4. A perforated drum drier as defined in claim 1, further comprising a partition slidable from a position underneath said lower inlet opening to a position

5. A perforated drum drier as defined in claim 1, further comprising a cooling drum rotatably mounted outside of said housing behind said front end wall thereof.

6. A perforated drum drier for alternately treating an open knit fabric or a tubular knit fabric, comprising a drier housing having front and rear end walls and an upper inlet opening and a lower inlet opening in said rear end wall, at least two drums rotatably mounted in a row behind and parallel to each other in said housing and having perforated peripheral walls, the first of said drums being located adjacent to said rear end wall, a wind screen mounted in said first drum near the peripheral wall thereof, said wind screen having a section substantially facing said inlet openings, said section being pivotable toward the inside of said drum, means connected to said drums for producing a suction at the inside of said drums, first lower feeding means connected to said rear end wall for feeding a tubular fabric through said lower opening to said first drum, and second upper feeding means located considerably above said first feeding means and comprising a front guide roller mounted within said housing, a rear guide roller mounted outside of said housing and spaced from said rear end wall, a pair of endless pin-studded stentering chains parallel to and laterally spaced from each other and movable between and over said guide rollers and forming upper and lower chain stringers extending substantially horizontally between said guide rollers and through said upper opening into and from said housing, and means for rotating said drums and for driving said chains, said first guide roller having an axis located at a short distance beyond a vertical plane extending through the axis of said first drum and so far above said first drum that the part of said lower stringers adjacent to said front guide roller is substantially in horizontal alignment with the top of the perforated wall of said first drum so that an open fabric fed on said upper stringers toward said first guide roller, after passing around the latter and turning an angle of substantially 180° to reverse the direction of travel, will be removed from the pins of said chains by its own gravity and by the suction of said first drum and will be transferred substantially simultaneously to the peripheral perforated wall of said first drum while said drum is rotating in the same general direction in which said lower stringers are moved substantially horizontally.

7. A perforated drum drier as in claim 6 further comprising a steamer associated with said second feeding means and located outside of said housing in a position before the entry of said chains through said upper opening into said housing for preheating and moistening the open fabric on the upper stringers of said chains.

* * * * *